United States Patent [19]

Tezuka et al.

[11] Patent Number: 4,948,273

[45] **Date of Patent: * Aug. 14, 1990**

[54] DRIVE MECHANISM FOR A MINIATURE PRINTER

[75] Inventors: Chikao Tezuka; Yukihiro Hanaoka; Hiroyuki Nakayama, all of Shiojiri, Japan

[73] Assignee: Seiko Epson Corporation, Tokyo, Japan

[ * ] Notice: The portion of the term of this patent subsequent to Nov. 29, 2005 has been disclaimed.

[21] Appl. No.: 186,844

[22] Filed: Apr. 27, 1988

Related U.S. Application Data

[63] Continuation of Ser. No. 781,593, Sep. 30, 1985, Pat. No. 4,787,761.

[30] Foreign Application Priority Data

May 13, 1985 [JP] Japan ..... 60-100778

[51] Int. Cl.[5] ..... B41J 1/22

[52] U.S. Cl. ..... 400/185; 400/145.2; 400/320

[58] Field of Search ..... 400/143, 144.1, 144.3, 400/145, 145.1, 145.2, 157.1, 170, 185, 187, 320, 322, 328, 284, 332.2, 322.4, 322.6, 334.3, 146; 101/93.14, 93.16, 93.17, 93.28, 93.31, 93.32, 93.33, 93.35, 93.36, 93.40

[56] References Cited

U.S. PATENT DOCUMENTS

| | | | |
|---|---|---|---|
| 138,437 | 4/1873 | Richardson | 346/139 D |
| 2,606,092 | 8/1952 | Rich | 346/139 D |
| 2,913,091 | 11/1959 | Neumann | 400/332.4 X |
| 3,279,576 | 10/1966 | Howard | 101/93.16 X |
| 3,442,365 | 5/1969 | Ragland, III et al. | 400/144.3 |
| 3,651,916 | 3/1972 | Becchi | 101/93.17 X |
| 3,926,061 | 12/1975 | Paulson | 74/22 R |
| 4,410,289 | 10/1983 | Koike et al. | 400/185 |
| 4,437,776 | 3/1984 | Hirano | 400/145.2 X |
| 4,443,123 | 4/1984 | Ono et al. | 400/146 X |
| 4,787,761 | 11/1988 | Tezuka et al. | 400/145.2 |

FOREIGN PATENT DOCUMENTS

| | | | |
|---|---|---|---|
| 87057 | 5/1983 | Japan | 400/328 |
| 107379 | 6/1983 | Japan | 400/328 |
| 29166 | 2/1984 | Japan | 400/146 |

*Primary Examiner*—David A. Wiecking
*Attorney, Agent, or Firm*—Blum Kaplan

[57] ABSTRACT

A small-sized printer has a carriage moving in front of a platen. A print wheel is rotatably mounted on the carriage and coupled to a print wheel gear. The print wheel gear meshes with two worm gears which extend parallel to the platen. A rack-like cam also lies parallel to the platen and is followed by rocking lever which drives a pivoted hammer support. A pivoted hammer on the pivoted support strikes the inside of the print wheel, forcing an inked character to print on the paper, and rolling the character on the paper as the carriage moves. The two worm gears are powered by a motor which acts through a print drive. Their rotation is controlled so that the print wheel is rotated for print character selection by rotating both worm gears to turn the print wheel gear, the carriage is caused to move along the print line by stopping rotation of one of the worm gears, and the carriage is caused to return to its original position by stopping the other worm gear.

32 Claims, 9 Drawing Sheets

FIG. 6
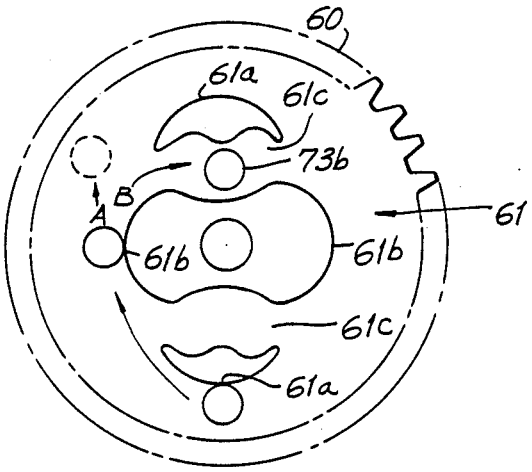
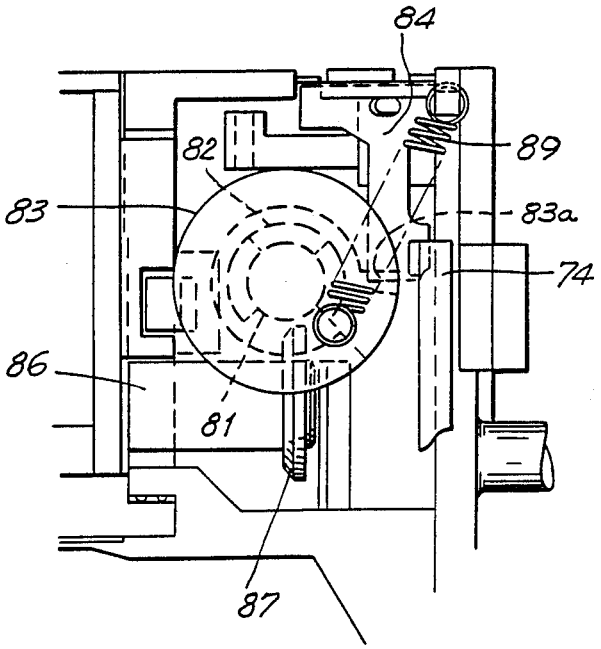
FIG. 7

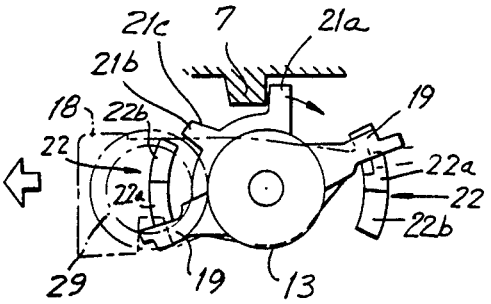
FIG. 10(a)
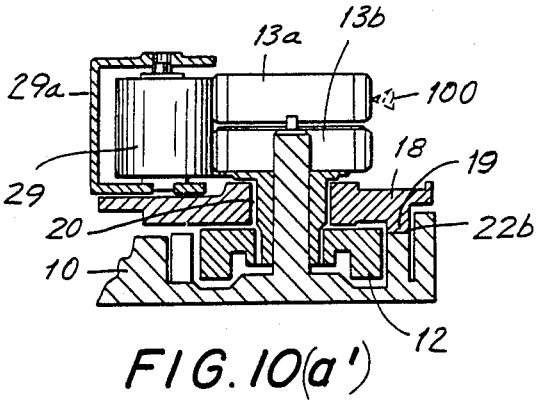
FIG. 10(a')
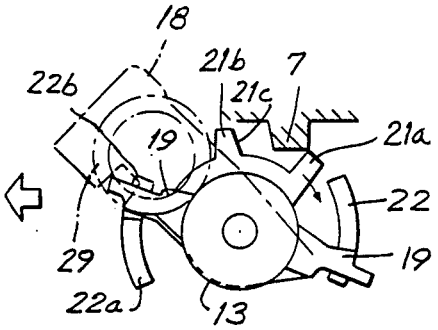
FIG. 10(b)
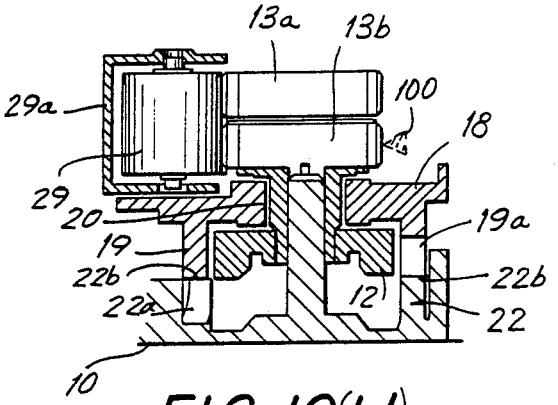
FIG. 10(b')
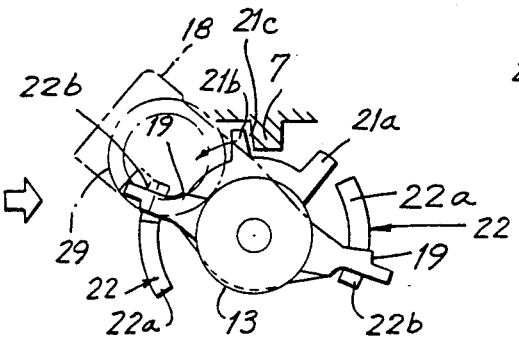
FIG. 10(c)
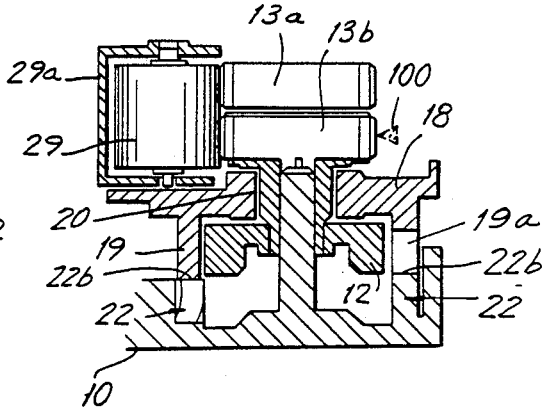
FIG. 10(c')

DRIVE MECHANISM FOR A MINIATURE PRINTER

This is a continuation of application Ser. No. 06/781,593, filed Sept. 30, 1985, now U.S. Pat. No. 4,787,761, issued Mar. 29, 1988.

BACKGROUND OF THE INVENTION

The present invention relates to printers of a small size, e.g., to miniature printers. More particularly, the invention relates to such printers in which a mechanism is employed for selecting print characters as a carriage is moved along a print line and then is returned to its home position.

Miniature printers are often used in desktop calculators, electronic cash registers, and the like, to move a print wheel to a desired print position in front of a piece of paper which is to be printed on, to rotate the wheel to select a desired print character, and then to print the character. In general, printers of this kind have a rotating mechanism for selecting print characters which is independent of the mechanism that is used for moving the print wheel along the print line. The structure of the printer is therefore complicated and is difficult, if not impossible, to manufacture in the small size which has been demanded.

An apparatus is disclosed in the U.S. Pat. No. 4,437,776 which attempts to solve this problem by using a drive in which a worm meshes with a worm gear that is made integral with the print wheel. A rack is moved in and out of engagement with the worm gear so that movement of the print wheel in rotation and in translation are accomplished in one mechanism. Another apparatus which addresses the problem is disclosed in Japanese Laid-Open Patent No. 107379/1983, where a worm gear which is integral with a print wheel meshes with two worms which rotate at different angular velocities, simultaneously rotating the wheel and moving it along the print line. The apparatuses of the foregoing use greatly simplified mechanisms in an effort to solve the aforementioned problem. However, in the apparatus of the U.S. patent, when the rack comes into and out of engagement with the worm gear, their addendums abut against each other so that precise operation is not feasible. In addition, a large amount of electric power is consumed for moving the print wheel along the print line because the mechanism which returns the print wheel to its original state uses a tension spring against which the drive motor must work. In the apparatus of the Japanese laid-open patent the mechanism moves the print wheel along the print line by using the difference between two angular worm drive velocities, and a long time is necessarily consumed in returning the print wheel to its original angular position. Also the drive must be reversed to return the print wheel to its original angular position. Hence, the device is not well-suited for high-speed printing.

SUMMARY OF THE INVENTION

The foregoing problem is solved, in accordance with the present invention, in a miniature printer having a frame which supports a platen, a drive motor, and a pair of worm gears which are oriented parallel to the platen. Rotational energy is supplied from the motor to the parallel worm gears by means of a print drive which can selectively control the rotation of each worm gear. The carriage, which is supported on the frame for motion parallel to the worm gears and to the platen, carries a worm wheel which is meshed with both worm gears. A print wheel is mounted on a shaft and can be moved up and down in front of the platen to position one of two sets of print characters, which are disposed on its periphery, at the print line in front of the platen. A rack-like cam surface is disposed on the frame, parallel to the worm, at the level of the print wheel. A hammer support is pivotably mounted on the carriage and is driven in rotation, in a direction generally perpendicular to the platen, by a cam follower which contacts successive teeth on the cam and causes a print hammer to press the rear of a selected character in the print wheel outward towards the platen. The worm gears are rotated at the same angular velocities. When both worm gears are rotating, a print character can be selected, since the print wheel rotates on the carriage and the carriage does not move. To move the carriage and the print wheel along the print line, rotation of one of the worm gears is stopped. When the carriage is to be returned to its starting position, rotation of the other of the worm gears is stopped.

Shifting of the print wheel vertically, relative to the print line, for changing type groups, is accomplished by means of a print wheel shifting plate which is rotatably mounted beneath the print wheel on the carriage. This shifting plate is turned by a cam surface on the frame as the carriage returns to its starting position. As it turns, the lifting plate moves on lifting cam surfaces on the carriage, raising the print wheel. The motion is reversed to lower it again.

Paper can be shifted in front of the platen for the printing of successive lines by means of a roller which is supported on the frame and is driven by means of a segmented gear which receives its power from the worm gear which drives the carriage in its return to the starting position.

It is an object, therefore, of the invention to provide a compact mechanism for use in a miniature printer.

It is still an other object of the invention to provide a simple printer mechanism for use in a miniature printer which is easily manufactured in small size.

It is a further object of the invention to provide a miniature printer which is precise in its operation.

It is still another object of the invention to provide a miniature printer which is economical in the use of electric power.

It is still a further object of the invention to provide a miniature printer which can be produced at a low cost.

Still an other object of the invention is to provide a miniature printer in which the positions of print characters on a print wheel can be readily detected.

Still an other object of the invention is to provide a miniature printer whose control circuit can be greatly simplified.

Still a further object of the invention is to provide a printer in which it is possible to print characters simultaneously with motion of the carriage on which the print wheel is carried along the print line.

It is still a further object of the invention to provide a printer in which the print wheel rolls as the characters are printed so as to form good, vivid printed images on the printing medium.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description, taken in connection with the accompanying drawings, in which:

FIG. 6 is a view of the cam on the rear of the timing gear of the printer;

FIG. 7 is a plan view of the paper-feed mechanism of the printer;

FIGS. 10(*a*), 10(*b*) and 10(*c*) are plan views and FIGS. 10(*a'*), 10(*b'*), 10(*c*) are corresponding side sectional views illustrating the manner in which the print wheel is shifted in the apparatus of the invention.

DETAILED DESCRIPTION OF THE INVENTION

Figure 1:
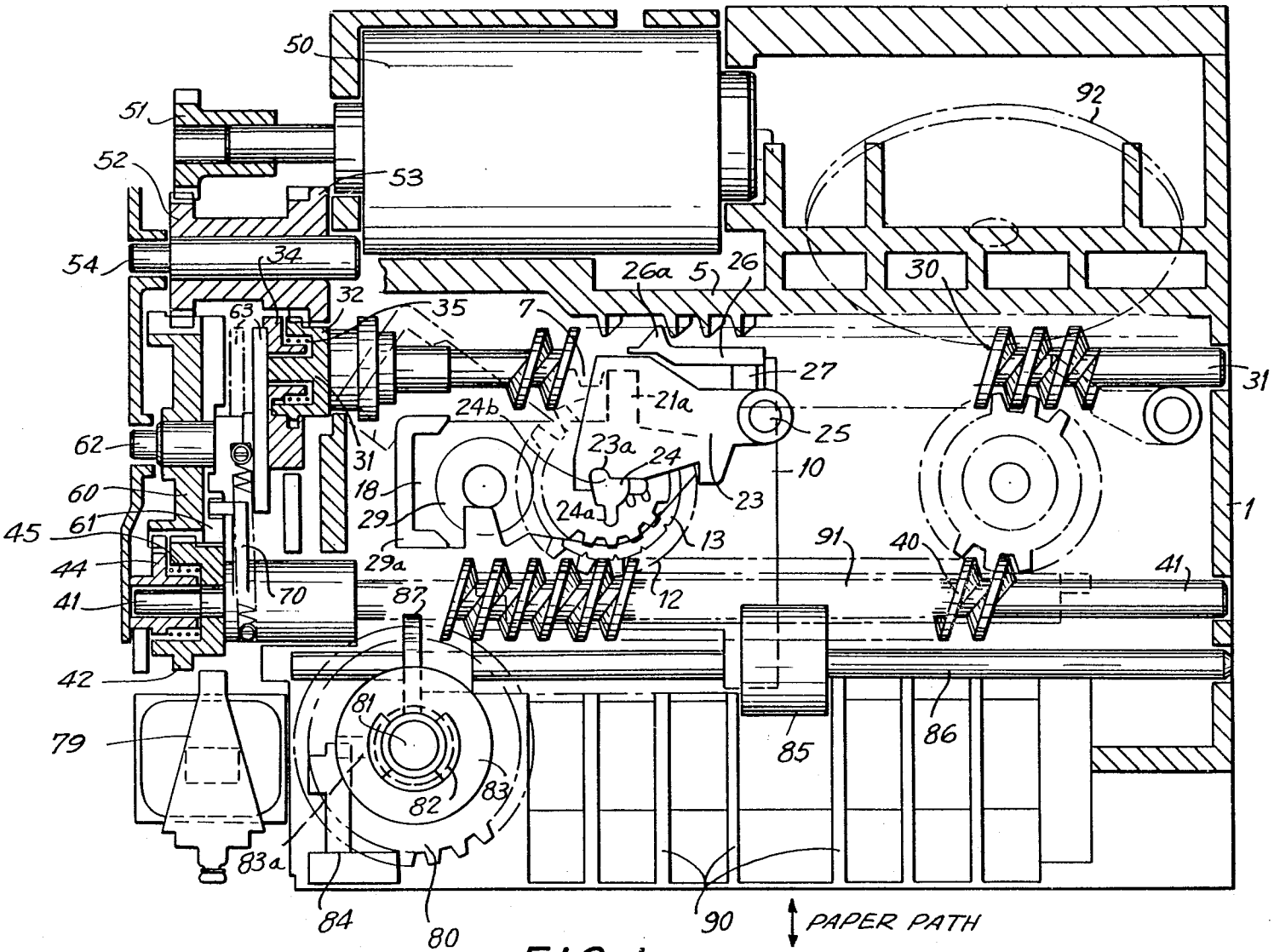
FIG. 1 is a top sectional view of a miniature printer fabricated in accordance with the teachings of the present invention.
Figure 2:
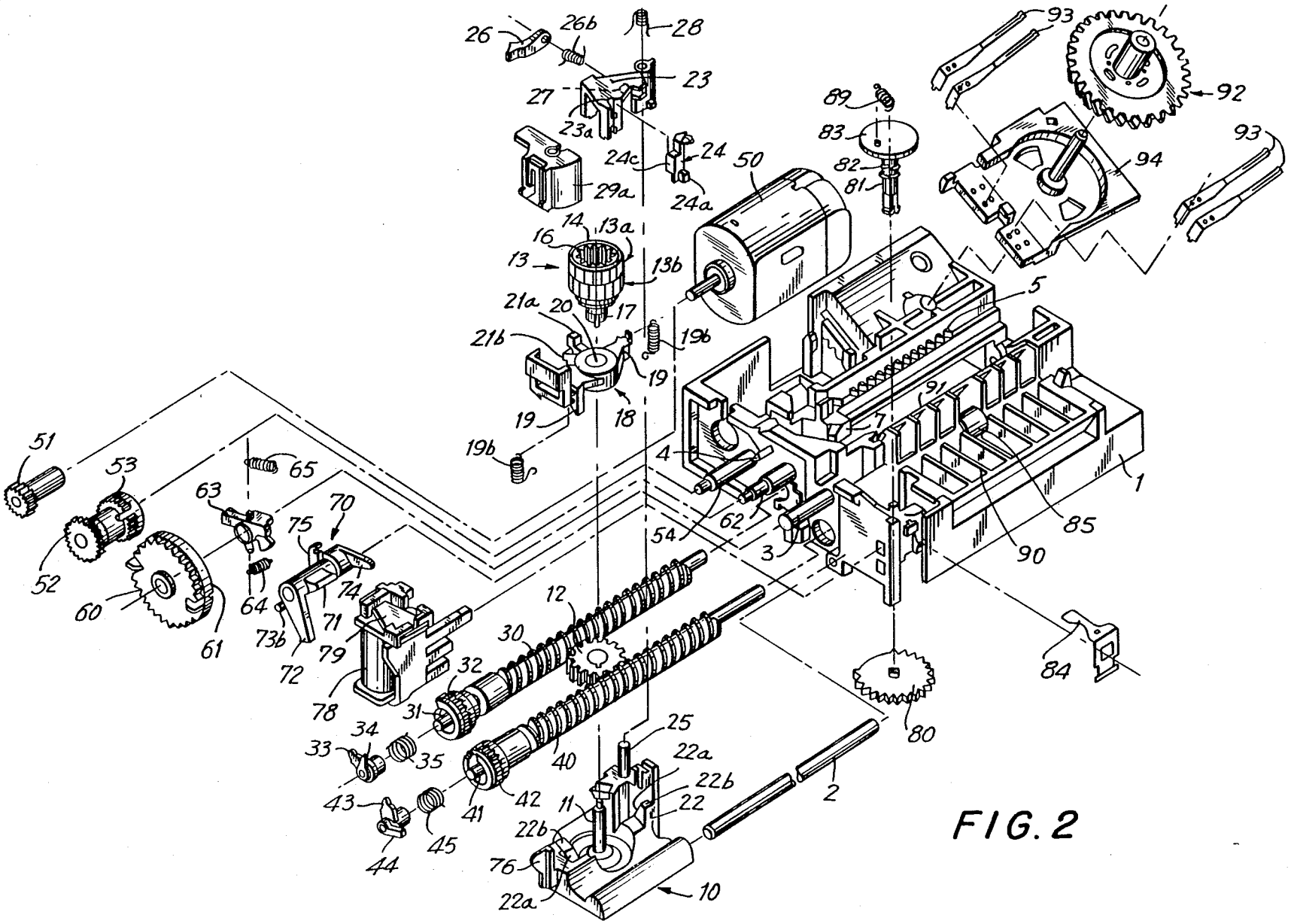
FIG. 2 is an exploded view of the printer of FIG. 1.
Figure 3:
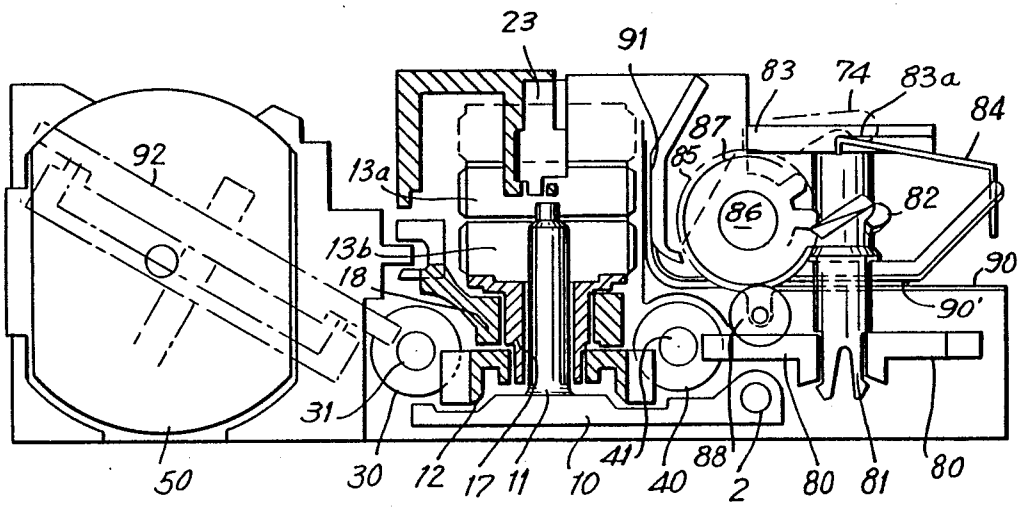
FIG. 3 is a sectional side elevational view of the printer.

The relationship of the main elements in the structure of a printer fabricated in accordance with the present invention are shown in plan view in FIGS. 1–3. Some details are better seen in later figures.

Figure 4:
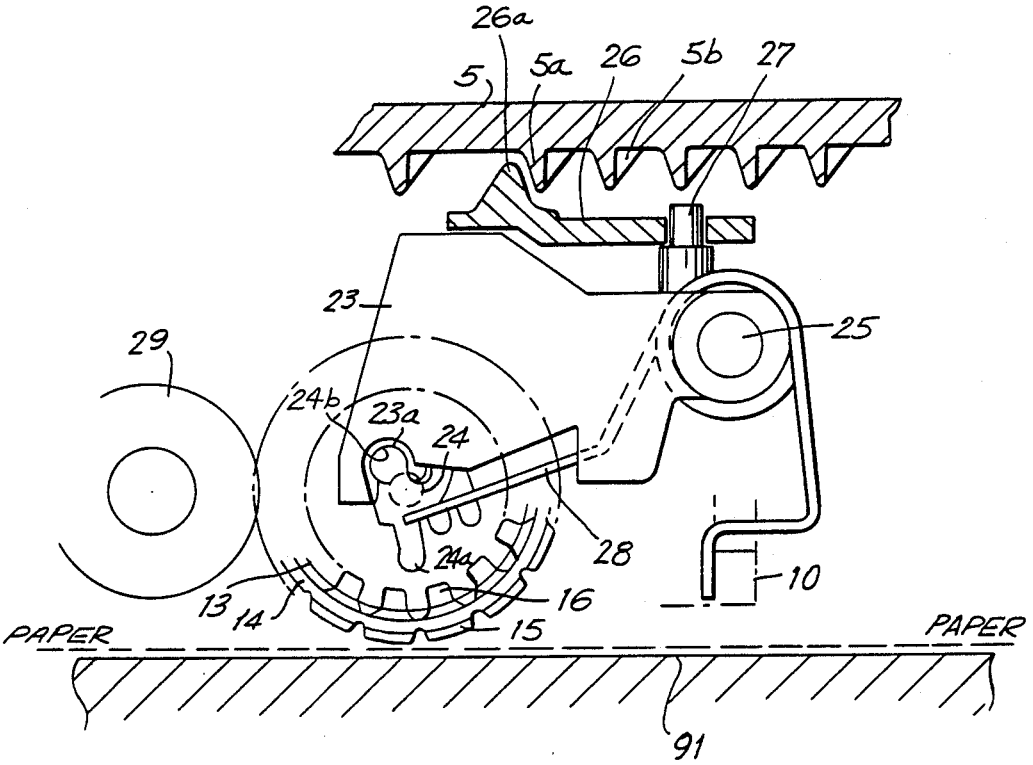
FIG. 4 is a plan view of the print wheel mechanism of the printer.

The printer has a frame 1 to which, as best seen in FIGS. 2 and 3, a guide rail 2 is firmly fixed. A carriage 10 is mounted so that it can move along a platen 91 while guided by guide rail 2. A print wheel, generally designated 13, is mounted on carriage 10 for travel back and forth in front of platen 91 (FIG. 2 and 4). The paper (not shown) to be printed on is supported between platen 91 and print wheel 13.

The line along which print wheel 13 moves in front of the platen 91 and at which characters and numbers may be printed is herein called the print line and is schematically represented in end view by pointer 100 in FIGS. 10(*a'*), 10(*b'*), and 10(*c'*). Paper is moved into printing position through paper groove 90' from a paper receiving surface 90 on frame 1 (FIG. 1 and 3) by means of a paper roller 85.

The printer includes mechanisms for controlling the selection of characters which are carried at either one of two levels 13*a* and 13*b* on print wheel 13 for printing a selected character 15, for moving carriage 10 along platen 91, and for advancing paper upwards past the platen 91. The drive mechanism which couples rotational motion from a motor to perform these functions responds to the control mechanism to selectively control the operation of the various elements of the printer.

As shown in FIGS. 2 and 3, the printing mechanism includes a print wheel support shaft 11 which projects upwardly from the surface of carriage 10. A sleeve 17, which is loosely mounted for rotation on shaft 11, carries print wheel 13 fixed to its top end. Print wheel 13 has two levels, 13*a* for numbers and 13*b*, for symbols. A print wheel drive gear 12 is fixed to the bottom end of sleeve 17. Print wheel 13 is held so that it can be slid vertically by a print wheel shift lever 18 which is fitted loosely around sleeve 17 between print wheel 13 and gear 12. Shift lever 18 is plate-like in form and acts to bring either one of numeral wheel 13*a* or symbol wheel 13*b* into printing position at the print line. Shift lever 18 is provided with a hole 20 (FIGS. 2 and 10) through which sleeve 17 extends and with two protrusions 21*a* and 21*b* each of which is formed on a side of shift lever 18 and extends outwards radially relative to hole 20. First protrusion 21*a* has a portion which extends upwards, parallel to the axis of hole 20. Second protrusion 21*b* has at least one oblique surface 21*c*. As best seen in FIG. 10, two projections 19, both of which have downward inclined surfaces 19*a* that face in the same circumferential direction, depend, on opposite sides of shift lever 18, from its lower surface. Shift lever 18 rides on trapezoidal cam members 22, each of which has an upwardly inclined surface 22*a* and a horizontal top surface 22*b*. Cam members 22 are integral with carriage 20, on opposite sides of shaft 11, and have upward-facing inclined surfaces 22*a* which bear against the inclined surfaces of projections 19.

Each time that carriage 10 moves towards its home position (at the left, as viewed in FIG. 1), the side of protrusion 21*a* comes to bear against a protrusion 7 which is formed on frame 1 near the home position of the carriage (FIGS. 1, 2, and 10). As a result, shift lever 18 is swung to the right (clockwise in FIGS. 10(*a*) and 10(*b*)). When the carriage movement is reversed, second protrusion 21*b* strikes fixed protrusion 7 swinging print wheel shift lever 18 back to the left (FIG. 10*c*). The rotations of shift lever 18 cause the sloping surfaces 19*a* of projections 19 to first ride up along inclined surfaces 22*a* and to then ride back down, being urged downwards by return springs 19*b* (FIG. 2). Shift lever 18 thus raises and lowers itself to position one or the other of print wheels 13*a* and 13*b* at the level of the print line.

Printing is accomplished by means of a hammer support lever 23 which is pivotally mounted on shaft 25 at one corner of carriage 10. Hammer support lever 23 extends horizontally above print wheel 13 and has a recess 23*a* located near the position at which the front end of the support lever meets the axis of rotation of print wheel 13. A type belt 14 carrying a plurality of print characters 15 (FIG. 4) is fitted around print wheel 13 and carries print characters at both level 13*a* and level 13*b*. Each outwardly protruding print character 15 has a rearward projection 16 which extends inwardly from the rear surface of the belt. A curved portion 24*b* of print hammer 24 is mounted in hammer lever recess 23*a*. A portion 24*c* of hammer 24 extends downward within print wheel 13, being rotatable in the plane of the print wheel to bring its outward-extending hammer head 24*a* into contact with the rearward projection 16 of a selected type 15. A spring 28*a* holds print hammer 24 in recess 23*a* and rotates it in a counter-clockwise direction therein so that it is held off of the print line and facing towards rear protrusion 16. At the beginning of the printing process, as shown in FIG. 4, hammer 24 and hammer head 24*a* are in position to strike the protrusion 16 which is located on the rear surface of the print character 15 and which is about to arrive in position for printing.

For printing, hammer lever 23 is driven in rotation about shaft 25 and against the force of spring 28 by the application of force to a shaft 27 which is formed integrally with the lever and which projects laterally therefrom in a direction perpendicular to the direction of motion of the carriage. A pawl-like, rocking lever 26 is rotatably mounted on shaft 27. As carriage 10 moves forward, i.e. to the right in FIG. 1, a laterally-extending tip 26*a* on rocking lever 26 encounters the slanted first surface 5*a* of rack-like printing cam 5. Printing cam 5 is fixed to frame 1 and extends in the direction of movement of carriage 10. As carriage 10 moves to the right, hammer support lever 23 is driven counter-clockwise toward print wheel 13 by the lateral movement of rocking lever 26 on first printing cam surface 5*a*. As the carriage continues to the right, a second upwardly-facing, inclined surface 5*b* (FIG. 4), formed on the reverse side of each tooth of cam 5, causes rocking lever 26 to rotate vertically against the force of spring 26*b* (FIG. 2), thereby allowing hammer support 23 to return to its initial position under the force of spring 28.

As best seen in FIG. 10, an ink roller 29, is mounted within a cartridge 29*a* and is carried on shift lever 18 and is continuously engaged with the printing surfaces of print belt 14.

Rotation of print wheel 13 and movement of carriage 10 along platen 91 are accomplished by means of a first double-helical worm gear 30 and a second double-helical worm gear 40 which are mounted on frame 1 and which lie parallel to carriage guide rail 2. Worm gears 30 and 40 both mesh with print wheel gear 12 (on carriage 10) and, when rotated at the same angular velocities, turn print wheel 13 to select a desired print character. As will be described later, worm gears 30 and 40 also move carriage 10 along the print line and return the carriage to its home position; at the latter time worm gear 40 powers the feeding of paper.

Figure 8A:
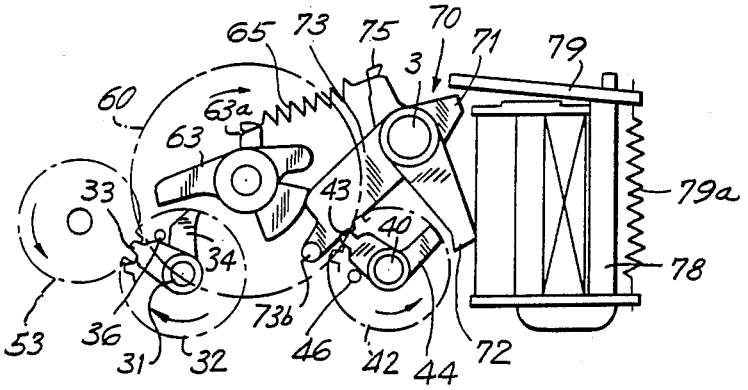
FIGS. 8(*a*), 8(*b*), and 8(*c*) are end views respectively illustrating operation of the control lever of the printer to select a print character, print a character on a print line, and return the carriage to its home position.
Figure 8B:
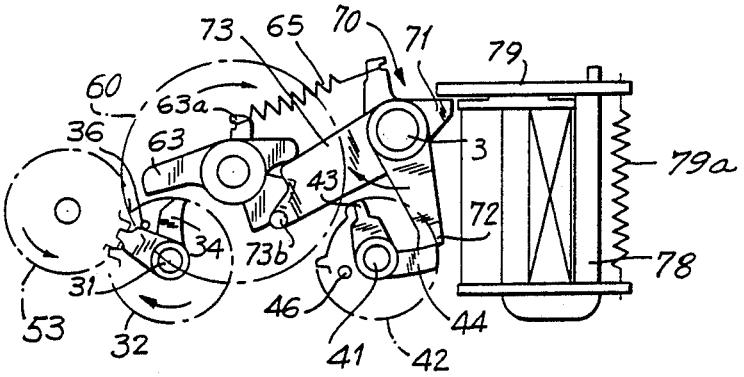
Figure 8C:
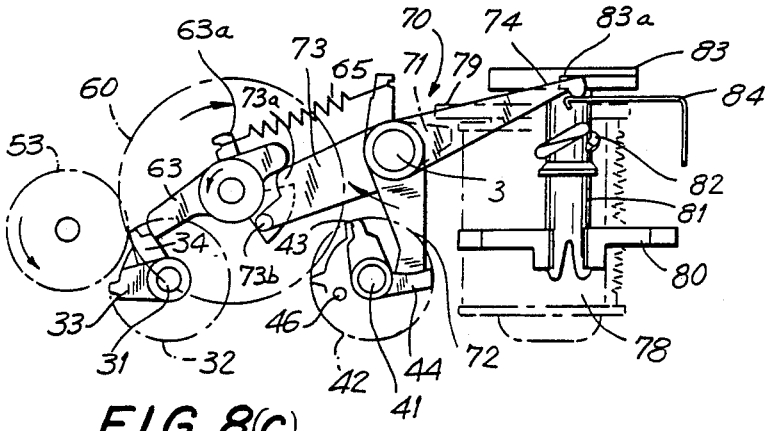
Figure 9A:
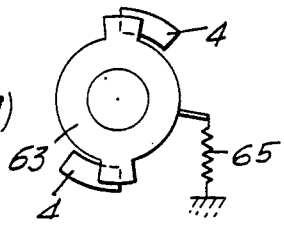
FIGS. 9(*a*), 9(*b*), 9(*c*) and 9(*d*) are plan views and FIGS. 9(*a'*), 9(*b'*), 9(*c'*) and 9(*d'*) are corresponding side views illustrating the operation of the return lever of the printer.
Figure 9A:
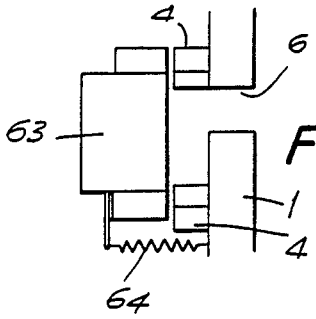
Figure 9B:
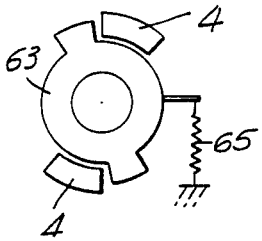
Figure 9B:
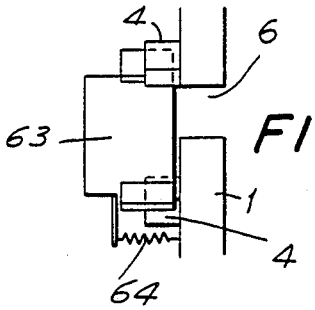
Figure 9C:
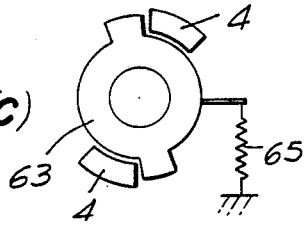
Figure 9C:
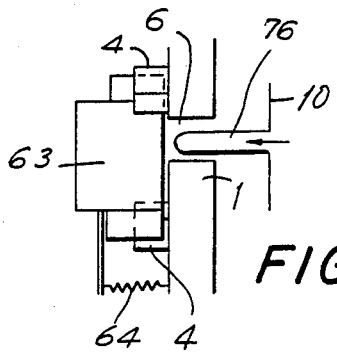
Figure 9D:
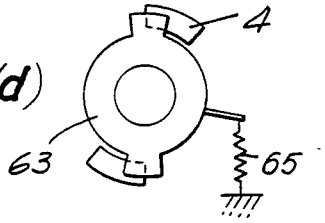
Figure 9D:
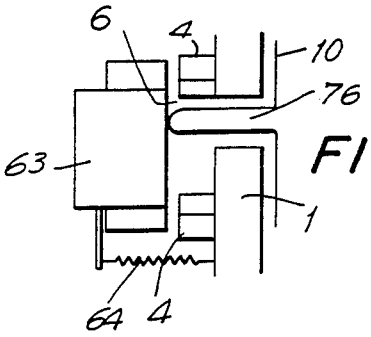

First and second drive shafts 31 and 41 of worm gears 30 and 40, respectively, are journalled in frame 1 and protrude therefrom at the left of the frame as viewed in FIG. 1. As shown in FIGS. 2 and 8, drive shafts 31 and 41 are driven by incompletely toothed or segmented worm drive gears 32 and 42, respectively. Segmented worm drive gears 32 and 42 each lack one tooth. First worm drive gear 32 meshes with a first intermediate gear 53 which is coupled to and rotates with a second intermediate gear 52 (FIG. 2). Coupled gears 52 and 53 are mounted on shaft 54 supported on frame 1. Second intermediate gear 52 is driven by a drive gear 51 which is turned by the shaft of an electric motor 50. Worm drive gear 42, on second worm shaft 41, is driven from second intermediate gear 52 via a timing gear 60. Timing gear 60 has twice the number of teeth as worm drive gear 42. Power is thus transmitted from drive motor 50 to worm drive gears 32 and 42 so as to rotate them at the same speeds in clockwise and counter-clockwise directions, respectively. Toothed levers 34 and 44, which each respectively have one tooth 33, 43 are shaped to make up for the missing teeth in the toothless portions of incompletely toothed worm drive gears 32 and 42. Toothed levers 34 and 44 are rotatably mounted on portions of worm gear shafts 31 and 41 which project beyond the worm drive gears. Springs 35 and 45 respectively urge first toothed lever 34 and second toothed lever 44 clockwise and counter-clockwise against stop pins 36 and 46 which are respectively carried on worm drive gears 32 and 42, into position so as to fill in for the missing teeth.

Withdrawal of toothed levers 34 and 44 from the toothless regions of segmented gears 32 and 42 is controlled by an operating control lever 70, directly, in the case of toothed lever 44, or indirectly via a return lever 63, in the case of toothed lever 34. Control lever 70 is pivotally mounted on shaft 3 which is fixed to frame 2 and has five control arms (best seen in FIGS. 2, 5 and 8(*c*)). Activator arm 71 extends into the path of a trigger lever 79 which is also the armature of a trigger electromagnet 78. When the electromagnet 78 is energized, trigger lever 79 is moved against the force of spring 79*a* so that actuator arm 71 rotates control lever 70 clockwise. One control arm 72 of control lever 70 can thus be moved into the path of rotation of second toothed lever 44 to engage it and to thereby withdraw tooth 43 from the toothless region of worm drive gear 42. Further rotation of control lever 70 is produced when pin 73*b* on a second control arm 73 of the lever is driven further by a cam 61 FIGS. 5 and 6) which is formed on the back of timing gear 60. Shoulder 73*a* (FIG. 8(*c*)) of arm 73 then rotates return lever 63 counterclockwise to intercept single-tooth lever 34 and thereby effects disengagement of first segmented worm drive gear 32 from intermediate drive gear 53. At the same time, third control arm 74, (FIGS. 2, 5 and 8(*c*)) presses against a lock lever 84 which interacts with recess 83*a* in paper feed drive disc 83 (See FIGS. 2 and 3) to stop rotation of paper feed drive shaft 81. The tip of a fourth control arm 75 receives energy for returning control lever 70 counterclockwise from coil spring 65 which stretches from a hook 63*a* on return lever 63.

Figure 5:
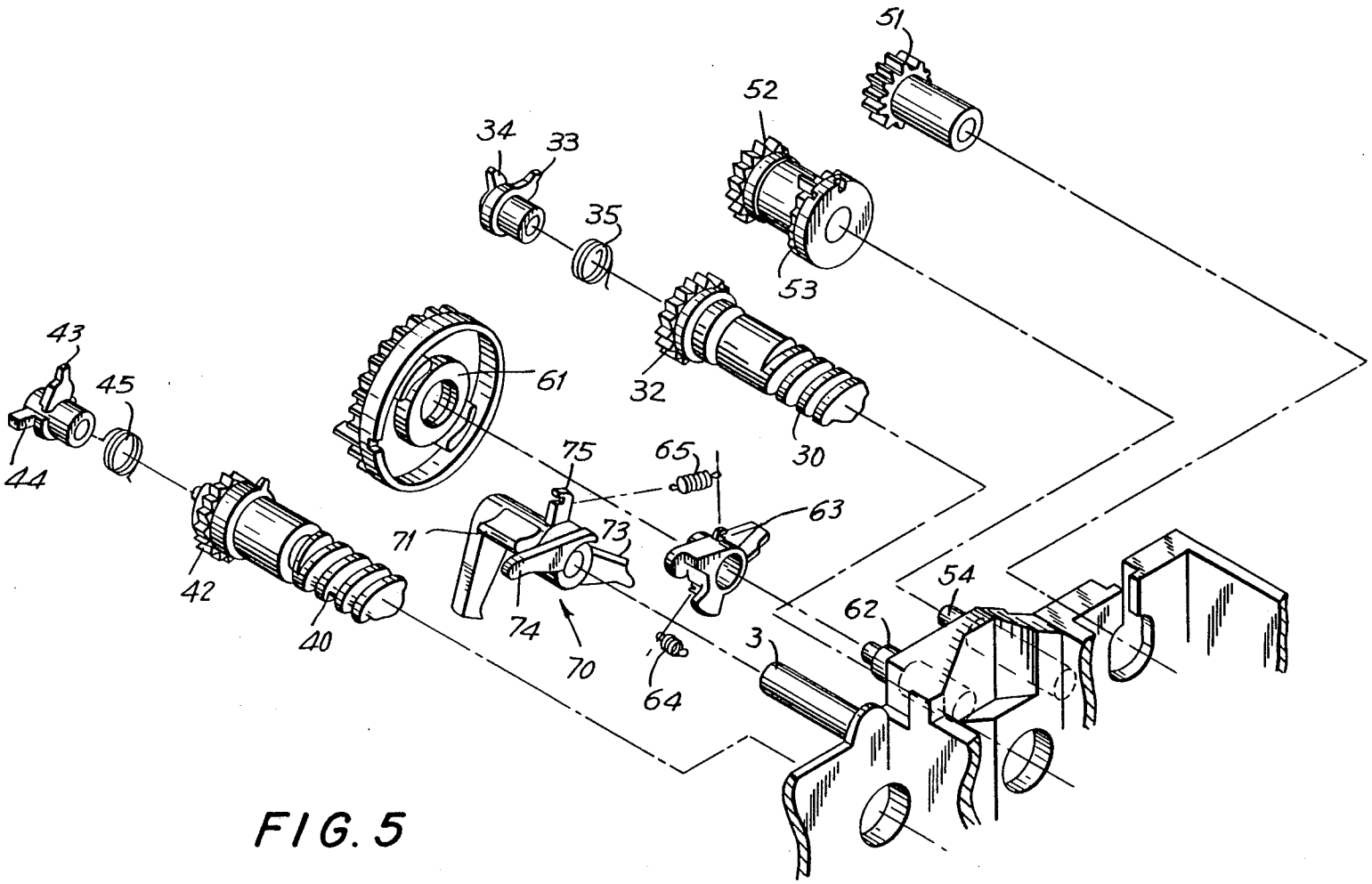
FIG. 5 is an exploded view of the power-transmitting drive mechanism of the printer.

The construction of cam 61 on the back surface of timing gear 60 is shown in FIGS. 5 and 6, where the manner in which pin 73*b*, carried at the outer end of control arm 73 (not visible in FIGS. 5 and 6), bears on the cam, can also be seen. Timing cam 61 is generally elliptic in overall form, but contains two grooves 61*c* across its major axis through either of which pin 73*b* can pass. When trigger lever 79 is actuated by electromagnet 78 and presses against control lever 70, pin 73*b* slides along the surface of cam 61 which extends from either of the points 61*a* on the major axis of the ellipse, to the next point 61*b* which lies on the minor axis. Grooves 61*c* of cam 61 are designed so that, when trigger electromagnet 78 is energized for an extended period which is twice the normal period, e.g., the time required for timing gear 60 to rotate through 180°, pin 73*b* is allowed to fall into the next (viewed as clockwise in FIG. 6) groove 61*c* so that control lever 70 is further rotated.

When return lever 63 is engaged by control lever arm 73, first toothed lever 34 is withdrawn from its position in the toothless region of first segmented drive gear 32. Return lever 63 is both rotatably and slidably mounted on shaft 62 of timing gear 60. The sliding movement of return lever 63 is controlled by movement of carriage 10. When carriage 10 is at the starting point of a print line, e.g., the left most position as seen in FIG. 1, protrusion 76, which is formed on the left-hand end of carriage 10 (FIGS. 2, 9(*c'*) and 9(*d'*)), pushes against return lever 63, causing it to slide outward against the force of return spring 64 (FIG. 9). Return lever 63 is then free to turn until its bottom surfaces rest on the tops of a pair of steps 4 which are formed on the adjacent outside surface of frame 1 (FIGS. 2 and 9). In this condition, return lever 63 is not in engagement with first toothed lever 34, leaving lever 34 free to return its tooth into the tooth gap of first worm drive gear 32. When return lever 63 is urged counter-clockwise by control arm 73, it rotates off of steps 4 and moves inwardly against frame 1. In this position it is in engagement with, and again blocks rotation of, first toothed lever 34, preventing the driving of first worm gear 30.

The paper-feed mechanism of the printer is best seen in FIGS. 1, 2, 3, and 7. The paper feed mechanism has a vertical worm shaft 81 which carries a segmented helical tooth made up of three helical elements 82 which are spaced 90° from each other on a circle. The helical tooth thus extends three quarters of the way around worm shaft 81. Worm shaft 81 is located out of the path of carriage 10. Rotary driving force for feeding the paper is transmitted to worm shaft 81, from second worm gear 40 via a segmented paper feed drive gear 80 (FIGS. 1 and 2) which is attached to the lower end of shaft 81. A lock lever 84 acts on a retaining portion 83*a* of a disk 83 which is carried on shaft 81 to prevent rotation of the toothless portion of segmented paper feed drive gear 80 into engagement with second drive worm 40. When control lever 70 (FIG. 8(*c*)) has been fully rotated through a large angle, control arm 74 comes down on lock lever 84, pushing it out of engagement with disc 83. The force of coil spring 89, acting between frame 1 and disk 83, rotates disk 83 to bring the teeth of paper feed drive gear 80 into mesh with second drive worm 40. Drive gear 80 is thus driven in rotation and helical tooth 82 turns roller drive gear 87, rotating shaft 86 and causing roller 85 to move the paper to the next print line.

The printer further includes a pressure roller 88 (FIG. 3) which rolls against paper-feed roller 85, a set of parallel fins which form a surface 90 on the frame for guiding the paper, and platen 91 which is supported opposite print wheel 13 and which provides a surface against which paper can be pressed by print wheel 13. The location of the paper in front of the platen is shown by the dashed line in FIG. 4. A rotary encoder wheel 92 is driven from first worm 30 and rotates in synchronism with it as shown in FIGS. 1–3 to actuate encoder contacts 93 which are supported on mounting plate 94.

The manner in which the printing apparatus of the invention operates is described below.

Selection of Print Characters

During selection of a print character, trigger electromagnet 78 is not energized and, as shown in FIG. 8(*a*), control lever 70 is urged counter-clockwise by spring 65. Therefore, control arm 72 of lever 70 lies outside of the path of second toothed lever 44 and third control arm 73 is out of contact with return lever 63. Thus, first and second toothed levers 34 and 44 rest against stops 36 and 46, respectively, and their teeth 33 and 43 fill in the gaps in segmented worm drive gears 32 and 42. Accordingly, first worm 30 receives rotary driving force which is transmitted from drive gear 51, via intermediate gears 52 and 53, to first segmented worm driving gear 32 and second worm gear 40 receives rotary driving force transmitted from drive gear 51, via intermediate gear 52 and timing gear 60, to second segmented worm drive gear 42. Print wheel 13 is rotatably coupled through sleeve 17 to print wheel gear 12 which meshes with worm gears 30 and 40. Therefore, rotation of worm gears 30 and 40 rotates print wheel 13 until a desired print character 15 is positioned opposite the surface of platen surface 91. Meanwhile, since print wheel gear 12 has been continuously meshed with worm gears 30 and 40, carriage 10 remain stationary relative to frame 1.

Movement Along a Print Line and Printing

When a desired print character 15 has been selected, trigger electromagnet 78 is energized for the amount of time required for timing gear 60 to make one quarter of a revolution. As shown in FIG. 8(b), trigger lever 79 is attracted by electromagnet 78 and causes first control arm 70 to be turned clockwise by pressing on actuator arm 71. This causes control arm 72 to move into the path of rotation of second toothed lever 44, stopping its rotation. As a result, tooth 43 of tooth lever 44 is withdrawn from the toothless region of second segmented worm drive gear 42, worm gear 42 comes out of mesh with timing gear 60, and rotation of worm 40 stops. At this time, return lever 63 is not engaged by operating arm 73 of control lever 70, even though the control lever has rotated in the direction which could bring this about, because return lever 63 remains seated, out of the way, on steps 4 of frame 1. First toothed lever 34 is therefore free and first segmented worm drive gear 32 continues to rotate.

Print wheel gear 12 is thus still driven by first worm gear 30 and rolls like a pinion on second worm gear 40 which is not turning and which serves as a rack on which gear 12 can travel. During one turn of first worm gear 30, carriage 10 is moved to the right by the force of worm gear 30 acting on print wheel gear 12 and thus on its shaft 17, into the next print position During this motion, print wheel gear 12 rotates very little. At the same time, rocking lever 26 is moved laterally by tooth 5*a*, out of cam 5, and impels hammer support lever 23 counter-clockwise. Then tip 24*a* of hammer 24, which is at the tip of lever 23 and is biased to the right by spring 28, is now impacted against the rear surface 16 of the selected print character 15. Print character 15, which has been inked by passage over ink roller 29, strikes the paper.

The impacted condition continues until rocking lever 26 has passed tooth 5*a* of cam 5. During the period of impact, print wheel 13 continues to turn clockwise and hammer 24 moves with it, pivoting in recess 23*a* of lever 23 to maintain hammer tip 24*a* in contact against the back 16 of print character 15. Character 15 is thus pressed and rolled against the paper, insuring that a clear image of the print character, numeral, or the like, is printed on the paper.

As carriage 10 continues to move to the right, tip 26*a* of rocking lever 26 begins to fall back between teeth 5*a* of cam 5. The force of spring 28 now acts to turn hammer lever 23 clockwise, moving hammer tip 24*a* away from the back surface of print character 15. Hammer 24 is now rotated counter-clockwise by spring 28 and returns to the condition shown in FIG. 4, ready for the next printing stroke.

Meanwhile, timing gear 60 has made the quarter revolution described above and pin 73*b*, at the tip of operating arm 73 (FIG. 6), has moved from point 61*b*, which lies on the major axis of elliptical cam 61, to point 61*b* which lies on the minor axis. When trigger magnet 78 is deenergized at the completion of the quarter turn, pin 73*b* moves away from cam surface 61 and follows the path marked by arrow A, avoiding falling into groove 61*c*. At the same time control lever 70 has been rotated counter-clockwise by action of spring 65 and returned to its original position. Second toothed lever 44 also resumes its original position, placing its tooth in the toothless region of second segmented worm drive gear 42. Second worm drive gear 42 now meshes with timing gear 60. Both worm gear 30 and worm gear 40 are again rotating and the apparatus is ready to select the next print character.

Carriage Return and Paper Feed

When carriage 10 has travelled the full length of a print line, or when the need to move to another line arises during the printing process, trigger electromagnet 78 is energized for a period of time which is twice as long as the time required for moving carriage 10 along a print line, i.e. the time which is required for timing gear 60 to rotate through 180°. Control lever 70, against which trigger lever 79 of electromagnet 78 is pressed, rotates clockwise as it did in the operation described above, and control arm 72 again prevents rotation of second toothed lever 44 so that the transmission of rotary motion to second worm gear 40 is interrupted.

During the first quarter turn of timing gear 60, pin **73*b*, at the tip of control arm 73, moves from point 61*a*, on the major axis of elliptic cam 61, to point 61*b*, on the minor axis (FIG. 6). As timing gear 60 continues to turn in the second quarter turn, pin 73*b* enters groove 61*c* as indicated by the arrow B in FIG. 6, and control lever 70 is now moved further, clockwise, than it was in the preceding example. As shown in FIG. 8**(*c*), the resulting movement of control lever 70 brings shoulder **73*a* of third control arm 73 to press against 63, rotating it counterclockwise. Now, as shown in FIG. 9**(*a*), return lever 63, which has been seated on steps 4 of frame 1, rotates out off of the steps and drops, under the force of spring 64, against frame 1 (FIG. 9(*b*)), allowing the tip of return lever 63 to move into the path of toothed lever 34, stopping its rotation (FIG. 8(*c*)). With tooth 33 of return lever 34 withdrawn from the toothless portion of first segmented worm drive gear 32, the transmission of rotary motion to worm 30 from intermediate gear 53 is interrupted.

This condition endures, even after timing gear 60 has rotated through 180° and trigger electromagnet 78 has been deenergized and after pin **73*b*, at the tip of third lever 73, escapes from groove 61*c* in cam 61, freeing selector lever 70 to be turned counter-clockwise by the pull of spring 65. This frees second toothed lever 44 of constraint and its tooth 43 returns to the toothless region of second segmented worm drive gear 42. Gear 42 again meshes with timing gear 60 and transmits rotary power to second worm gear 40**.

Since first worm gear 30 is still kept stationary, print wheel gear 12 now receives a rotary driving force from second worm gear 40 which is opposite in direction from that previously received. Print wheel gear 12 now rolls on first worm gear 30 and the thrust transmitted to print wheel gear shaft 25 causes carriage 10 to return to its home position at FIG. 1. When carriage 10 arrives at the home position, protrusion 76, on the left end of carriage 10, pushes out through hole 6 in frame 1 and moves return lever 63 away from the frame so that it turns under the influence of spring 65 and reseats itself on steps 4 (FIGS. 9(*c*) and (*d*)). Return lever 63 thus releases second toothed lever 44 which now returns to its original state as shown in FIG. 8(*a*). Rotary motion of first worm gear 30 is restarted.

While carriage 20 has been moving back to its home position, rocking lever 26 (FIG. 4) passes over inclined surfaces **5*b* on the reverse sides of the teeth of rack 5, swinging upwards about shaft 27 as it goes. The return action of the carriage is thus smoothly accomplished without driving hammer support 23**.

Feeding of paper during carriage return is accomplished as follows. When control lever 70 is moved clockwise by pin **73*b* in the last part of its full travel, the tip of control arm 71 contacts and pushes lock lever 84 downward, disengaging lock lever 84 from recess retaining portion 83*a* in disk 83 (FIG. 8**(*c*)). Disk 83 is then free to turn, under the pull of spring 89, to bring segmented paper-feed gear 80 into engagement with the helical teeth of second worm gear 40, which it has heretofore not engaged. With the release of control lever 70 by cam 61, rotation of second worm gear 40 is restarted. The driving of segmented paper-feed wheel 80 second worm gear 40 causes helical segment 82 to turn helical gear 87 which rotates paper feed roller shaft 86. Paper-feed roller 85 now moves the paper into position for receiving the next line of print. This operation continues until carriage 10 returns to its home position, whereupon segmented paper-feed wheel 80 is disengaged from second worm gear 40 by virtue of the presence of its toothless region. Now, paper feed wheel 80 is again held against rotation by lock lever 84, preventing the feeding of paper.

Print Wheel Shift

When carriage 20 is being restored to its home position by the return operation described above, first protrusion **21*a*, (FIG. 10) which extends perpendicularly from shift lever 18, strikes protrusion 7 which lies on frame 1 at a point immediately before the home position (FIG. 1 and 10). Continued motion of carriage 10**(*c*) causes shift lever 18 to turn clockwise about sleeve 17, with its depending projections 19 riding on upwardly inclined surfaces **22*a* of cams 22. Shift lever 18 is forced upward by top surfaces 22*a* as it continues to rotate. As it rises, shift lever 18 raises print wheel 13 to position symbol print wheel 13*b* at the location which has previously been occupied by numeral print wheel 13*a*, e.g., at the level of the print line (FIG. 10**(*b'*)).

While symbols print wheel **13*b* is at the level of the print line, the operations for selecting print characters and for printing characters on the next print line are repeated as carriage 10 again moves from its home position to the right. After carriage 10 has moved three or four print positions from the starting point of the print line, e.g., after the carriage has moved past the two or three print positions at which symbols are ordinarily printed, second protrusion 21*b*, which has been rotated to its laterally extending position as a result of rotation of lever 18, comes to bear on protrusion 7 of frame 1 (FIG. 10**(*b*)) and motion of the carriage continues, causing shift lever 18 to turn counter-clockwise (FIG. 10(*c*)). Shift lever 18 then is lowered by the action of inclined sufaces **22*a* of cams 22, and numeral wheel 13*a*** is returned to the printing location ready for printing of numerals.

In the processes described above, the operations for selecting print characters, printing characters on the print line, returning the carriage, and feeding paper are carried out using two oppositely-rotating worm gears. It will be understood that the same operations may be carried out by means of oppositely directed helices on worm gears which are turning in the same direction.

As described above, the novel apparatus of the invention utilizes a gear for rotating a print wheel which is meshed with two worm gears. The worms are selectively caused to rotate and to stop by means of a control device to: permit selection of print characters on the print wheel by rotating the two worm gears simultaneously; move the carriage along a print line by halting one worm gear; and return the carriage to its home position by halting the other worm gear. In this way, the operations of the printer are simply controlled by selective actuation of only the two worm gears ,while the motor which drives them rotates at all times in the same direction. The mechanism of the printer is thus greatly simplified. Further, there is no need to move the carriage along a print line against the force of a return spring or the like. Consequently, the size of the drive motor and its associated components, which have heretofore occupied a large space and which account for a considerable portion of the price of the printer, is substantially reduced. Thus, the size of the whole printer is minimized, the printer costs less, and the printer uses less electric power.

Further, since the worm wheel which meshes with the two worm gears is integral with the print wheel, the motion of the print wheel is under complete control. The positions of print characters, therefore, are always accurately located. Using simple detecting means, the number of turns made by the driving worm is easily counted so that the angular position of the print wheel is easily established and greatly simplifed circuits for controlling these operations may be used. Since the head of the print-character hammer is actuated for printing character by a toothed cam surface which is disposed parallel to the driving worms, characters are printed simultaneously with the shift of the carriage along the print line, permitting a substantial reduction in the time taken to print characters. Finally, since characters are printed while the print wheel is rolling, vivid printed images are formed on the printing medium.

It will thus be seen that the objects set forth above, among those made apparent from the preceding description, are effectively attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A drive mechanism useful in miniature printers and the like, the drive mechanism comprising;

a frame;

a motor mounted on the frame;

a first rotatable worm gear and a second rotatable worm gear supported parallel to one another on the frame;

worm wheel means in mesh with both of the first and second worm gears;

print wheel means coupled to the worm wheel means, the print wheel means comprising a plurality of print characters each of which is operable for printing an image of itself on a print line of a recording medium;

drive means for coupling rotary motion from the motor to each of the worm gears; and control means for selectively operating the drive means, whereby each worm gear can be caused to selectively rotate and stop independently of the other.

2. The drive mechanism of claim 1 and further comprising;

carriage means mounted on the frame for motion parallel to both of the worm gears, the worm wheel means and the print wheel means being rotatably mounted on the carriage means.

3. The drive mechanism of claim 2 wherein the control means acts to stop rotation of the second worm gear whereby the first worm gear drives the worm wheel means in rolling motion on the second worm gear to move the carriage and the print wheel means along the print line.

4. The drive mechanism of claim 3 wherein the control means is responsive to a control signal for interrupting transmission of power from the motor means to the second worm gear.

5. The drive mechanism of claim 2 wherein the the print wheel means is movable along a print line and wherein the drive means turns both of the worm gears at the same angular rate, whereby the worm wheel means rotates the print wheel means to position a print character for printing at the print line.

6. The drive mechanism of claim 5 in which the control means is selectively operable to cause the first and second worm gears to rotate the print wheel means for selecting a print character for printing, to cause the second worm gear to stop rotating so as to advance the carriage means along the print line, and to cause the first worm gear to stop rotating so as to return the carriage means to a starting position along the print line.

7. The drive mechanism of claim 5 wherein the control means acts to stop rotation of the first worm gear whereby the second worm gear drives the worm wheel means in rolling motion on the first worm gear to return the carriage means and the print wheel means to a starting position.

8. The drive mechanism of claim 7 wheren the control means is responsive to a control signal for interrupting the transmission of power from the motor means to the first worm gear.

9. The drive mechanism of claim 7 further comprising a platen on the frame, the platen mounted parallel to the path of motion of the carriage means, and cam means mounted on the frame opposite to the platen, hammer means mounted on the carriage means for motion towards the platen; and cam follower means connected to the hammer means, the cam follower means responding to the cam means, when the carriage is moved parallel to the platen, to cause the hammer means to strike a print character from the rear.

10. The drive mechanism of claim 9 in which at least a portion of the hammer means is pivotally supported so that the hammer means remains in contact with the rear of the print character, while the carriage means moves, thereby effecting a rolling imprint.

11. A printing mechanism useful in a miniature printer, the printing mechanism comprising:

a frame;

a platen mounted on the frame;

a motor mounted on the frame;

a pair of rotatable worm gears supported parallel to one another on the frame;

first drive means for coupling rotary motion from the motor to the pair of worm gears;

control means for selectively operating the first drive means to couple said rotary motion to each of the worm gears so that each of the worm gears may be rotated and stopped independently from one another;

worm wheel means in mesh with both worm gears;

print wheel means coupled to the worm wheel means, the print wheel means positioned facing the platen for printing, the worm wheel means and the print wheel means being movable along the platen to a starting position by operating one of the worm gears;

second drive means for moving a recording medium between the print wheel means and the platen; and means responsive to the return of the print wheel means to the starting position for coupling the second drive means to said one of the worm gears so as to move the recording medium in front of the platen.

12. The printing mechanism of claim 11 wherein the second drive means further comprises:

roller means for moving the recording medium;

print feed worm wheel means coupled to the roller means;

worm shaft means coupled to the feed worm wheel means; and print feed drive gear means rotating the worm shaft means, the print feed drive gear means adapted to be coupled to said one of the pair of worm gears upon return of the worm wheel means and the print wheel means to the starting position.

13. The printing mechanism of claim 12, in which the print feed drive gear means comprises an incompletely toothed gear having toothless and toothed portions, the toothed portion normally out of engagement with said one of the pair of worm gears; and wherein the means responsive to the return of the print wheel means to the starting position rotate the print feed drive gear means into mesh with said one of the pair of worm gears.

14. The printing mechanism of claim 13 wherein the worm shaft means comprises a segmented worm, the segmented worm remaining stationary when the print feed drive gear means is out of engagement with said one of the pair of worm gears.

15. The printing mechanism of claim 14 further comprising:

latch means operable for maintaining the print drive gear means out of engagement with said one of the pair of worm gears.

16. The printing mechanism of claim 15 in which the worm wheel means and the print wheel means are carried on a carriage means which is movable along a path in front of the platen and further comprising:

cam means connected to the carriage means; and control lever means on the frame, the control lever means responsive to contact by the cam means, upon return of the carriage means to the starting position, to release the latch means from maintaining the print drive gear means out of engagement with said one of the worm gears.

17. A printing mechanism, useful in a miniature printer, comprising;

frame means;

carriage means supported on the frame means for motion parallel to a print line;

print wheel means rotatably supported on the carriage means, the print wheel means comprising a plurality of print characters each of which is capable, when pushed from the rear, of printing an image of itself on a print line of a recording medium;

hammer means pivotable about a first axis, mounted on the carriage means for motion towards the print line, and including a cam follower support means;

cam means mounted on the frame means in a stationary position and which includes a rack having a plurality of teeth, said teeth lying parallel to the print line; and cam follower means pivotably supported on the cam follower support means of the hammer means for pivoting about a second axis which extends in a direction different from said first axis, said cam follower means being displaced in response to the cam means when the carriage is displaced in a first direction, and to be pivotably displaced about the second axis on the cam follower support means when the carriage is displaced in a second direction to avoid causing the hammer means to pivot and strike the rear of a print character;

each of the teeth of the rack having leading surface means which lies perpendicular to the line of motion of the cam follower means for driving the cam follower support towards the rear of one of the print characters during printing, and trailing surface means which is sloped at a angle to the line of motion of the cam follower means for pivoting the cam follower means to prevent the hammer means from striking the rear of said one of the printing characters during the return of the carriage means to the beginning of the print line.

18. The printing mechanism of claim 17 in which each trailing surface means is inclined relative to the leading surface means so as to direct the cam follower means away from a distal portion of the loading surface means as the carriage means returns to the beginning of the print line.

19. The printing mechanism of claim 17 and further comprising;

drive means coupled to the print wheel means for rotating the print wheel means to position a print character for printing.

20. The printing mechanism of claim 19 and further comprising:

means on the frame for coupling rotational motion to the drive means to position a selected print character for printing on the print line.

21. The printing mechanism of claim 17, wherein the first axis and the second axis extend in substantially perpendicular directions.

22. The printing mechanism of claim 12 in which the cam follower support means comprises a lever which is rotatably mounted on the carriage means, the lever comprising a recess in which the hammer is pivotably supported.

23. The printing mechanism of claim 22 in which the hammer is pivotably mounted on the cam follower support means and in which the hammer further includes a hammer surface which remains in contact with the rear of a print character during motion of the carriage means to the next printing position, thereby effecting a rolling imprint.

24. The printing mechanism of claim 17 in which the hammer means further includes a hammer mounted on the cam follower support means, and further comprising:

means for urging the hammer into an initial striking position relative to the cam follower support means.

25. The printing mechanism of claim 24 in which the hammer is pivotably mounted on the cam follower support means and in which the hammer further includes a hammer surface which remains in contact with the rear of a print character during motion of the carriage means to the next printing position, thereby effecting a rolling imprint.

26. The printing mechanism of claim 24, in which the cam follower support means comprises a recess for pivotally receiving the hammer.

27. The printing mechanism of claim 24 in which the means for urging the hammer comprises a resilient member.

28. The printing mechanism of claim 27 in which the cam follower support means comprises a recess for pivotally receiving the hammer.

29. The printing mechanism of claim 27 in which the hammer is pivotably mounted on the cam follower support means and in which the hammer further includes a hammer surface which remains in contact with the rear of a print character during motion of the carriage means to the next printing position, thereby effecting a rolling imprint.

30. The printing mechanism of claim 27 in which the resilient member comprises a spring.

31. The printing mechanism of claim 30 in which the cam follower support means comprises a recess for pivotally receiving the hammer.

32. The printing mechanism of claim 30 in which the hammer is pivotably mounted on the cam follower support means an in which the hammer further includes a hammer surface which remains in contact with the rear of a print character during motion of the carriage during motion of the carriage means to the next printing position, thereby effecting a rolling imprint.

* * * * *